United States Patent [19]

Pollock et al.

[11] Patent Number: 4,602,957

[45] Date of Patent: Jul. 29, 1986

[54] MAGNETIC POWDER COMPACTS

[75] Inventors: Harriet C. Pollock; Andrew L. Smith, both of London, England

[73] Assignee: EMI Limited, Hayes, England

[21] Appl. No.: 773,129

[22] Filed: Sep. 6, 1985

[30] Foreign Application Priority Data

Oct. 12, 1984 [GB] United Kingdom ..... 8425860

[51] Int. Cl.[4] ..... B22F 3/00

[52] U.S. Cl. ..... 75/246; 419/23; 419/25; 419/38; 419/39; 419/37; 419/57

[58] Field of Search ..... 419/23, 25, 37, 38, 419/39, 57; 75/246

[56] References Cited

U.S. PATENT DOCUMENTS 1,403,305 1/1922 Elmer ..... 419/35 X
1,523,109 1/1925 Elmer ..... 419/35 X
3,884,729 5/1975 Jackson et al. ..... 419/8 X
4,261,745 4/1981 Watanabe ..... 419/8

OTHER PUBLICATIONS

"The Magnetic Circuit," by A. E. De Barr, The Institute of Physics, London, England, 1953, pp. 19–24.

*Primary Examiner*—Stephen J. Lechert, Jr.
*Attorney, Agent, or Firm*—Fleit, Jacobson, Cohn & Price

[57] ABSTRACT

A magnetic powder core, suitable for use in a low frequency power device, is prepared by a method including the steps of coating an atomized iron powder from an aqueous solution of potassium dichromate, drying the powder, compressing the powder to form a compact and heat treating the compact until it becomes partially sintered. Cores having coercivities below 240A/m, saturation inductions exceeding 1.3 Tesla and resistivities exceeding 500 microhm cm are disclosed.

14 Claims, No Drawings

MAGNETIC POWDER COMPACTS

This invention relates to compacts of iron powder which are suitable for use as cores in low frequency power devices such as power inductors and mains transformers. The invention is particularly suitable for use as an alternative to silicon iron laminations in chokes for fluorescent lighting.

Compacts of iron powder are well known as lower power inductor cores for operation at communications frequencies, typically within the range 1 KHz to 100 MHz. Such compacts were in common use during the 1950's and are described, for example, in Chapter II of "The Magnetic Circuit" by A. E. De Barr published in 1953 by the Institute of Physics, although they have since been largely superseded by ferrite cores. These powder compacts were produced with very high resistivity, typically in the order of $10^4$ ohm cm compared with 10 ohm cm for bulk iron, in order that eddy current loss should be negligible within their operational frequency band, and methods for their preparation concentrated on maximising the insulation between particles, commonly involving the use of insulating resinous binders. Such compacts are not generally suitable for use as an alternative to laminations in power devices, however, since, although their eddy current loss is negligible, their hysteresis loss is markedly higher than the hysteresis loss of bulk iron. The coercivity of a core material is indicative of hysteresis loss, and such cores typically have coercivities in the order of 500 A/m compared with 80 A/m for bulk iron. Furthermore, the saturation induction of such compacts is generally low, typically in the order of 1.0 T compared with 2.0 T for bulk iron, and may give rise to non-linear performance in power devices. It has been known to insulate the particles with a heat resisting oxide or silicate before compacting at high pressure and to subject the compact to a heat treatment in order to obtain greater permeability and lower coercivity. While such compacts have been suitable for the lower frequencies of the communications frequency spectrum, they have not hitherto fully met the requirements for power devices. In a power device, operating typically within the frequency range 40 to 200 Hz, it is desirable for the coercivity to not exceed the order of 240 A/m and for the saturation induction to exceed the order of 1.3 T. Power devices, however, can tolerate a lower core resistivity than communications frequency devices and eddy current loss at power frequencies will generally remain acceptably low if the resistivity is permitted to fall as low as 500 microhm cm. It is apparent that the minimum requirements for power devices are intermediate between the properties of typical prior art powder cores and the properties of bulk iron. Such intermediate properties have hitherto been achieved by compressing thin flakes of iron into compacts; the cost of preparing iron in flake form is high compared with conventional atomised powder form, however and such compacts, although technically suitable, are too expensive for general commercial use in power devices.

It is an object of the present invention to provide compacts of iron powder which are suitable for use as cores in low frequency power devices.

According to one aspect of the invention there is provided a method of preparing a magnetic powder compact including the steps of coating an iron based powder from an aqueous solution of a soluble dichromate, drying said coated powder, compressing said coated powder in a die to form said compact and heat treating said compact such that said compact becomes partially sintered.

The invention will now be described by way of example. The invention is concerned with the provision of an insulating coating to the particles of an iron powder, compacting the powder under high pressure to form a core and heat treating the core such that the particles become annealed and partially sintered to have properties intermediate between those of a non-heat-treated core and a fully sintered core. A fully sintered core would have properties close to those of bulk iron, while a non-heat-treated compact would have properties which are typical of prior art powder cores.

A number of experimental approaches were made in attempts to provide the particles with an insulating coating which, associated with a suitable heat treatment, would result in a compact having the required properties. Of these approaches, one method of coating the particles consistently resulted in cores having markedly superior properties for power device application and forms the basis of the present invention. In order that the surprising nature of excellent results achieved from this one approach should be clearly appreciated, the remaining less successful approaches will first be briefly described.

METHOD 1

Iron powder was oxidised by baking at 230° C. for 40 minutes in air to form a black oxide surface layer. Toroidal compacts were pressed from the oxidised powders and the compacts were heat treated at 600° C. in air. The resistivity of these compacts after heat treatment was unacceptably low.

METHOD 2

Iron powder was mixed with an inert heat resisting insulating powder before pressing and heat treating. Toroidal compacts were formed from powder mixtures including 3% by weight of mica and from mixtures including 3% by weight of aluminium silicate, and the compacts were heat treated at temperatures within the range 500° C. to 700° C. The coercivity of these compacts was unacceptably high.

METHOD 3

Iron powder was mixed with various reactive powders before pressing to form toroidal compacts and heat treating at 600° C. The reactive powders included, separately, boric acid, borax and potassium dichromate in strengths ranging from 1% to 5% by weight. While the coercivity was acceptably low, resistivity and/or saturation induction were unacceptably low in all cases.

METHOD 4

Iron powder was coated from an aqueous solution of an inert heat resisting compound, sodium silicate, before pressing to form a toroidal compact and heat treating at 600° C. The coercivity of the resulting compact was unacceptably high.

METHOD 5

Iron powder was coated from aqueous solutions of various reactive compounds before pressing to form toroidal compacts and heat treating at 600° C. The reactive compounds selected were oxidising agents and included ammonium nitrate, borax, potassium pyrophosphate and potassium dichromate. Compacts pressed from powder coated from potassium dichromate solution had consistently acceptable properties for power devices, while none of the remaining solutions resulted in compacts which fully met the coercivity, resistivity and saturation induction requirements. This invention is concerned with the coating of iron particles from an aqueous dichromate solution, and is described in more detail in the following examples 1 to 7:

EXAMPLE 1

A high grade atomised iron power supplied by Hoganas of Sweden, type ASC 100.29 and having particle diameters within the range 75 to 150 μm was mixed with a 10% by weight aqueous solution of potassium dichromate and stirred for five minutes. The wet powder was then recovered through a filter and dried in an oven for 30 minutes at 140° C. The dried powder was lightly crushed and sieved through at 250 μm sieve and weighed. 0.8% by weight of a lubricant, Glokem type D2S, was added and the mixture was ball milled for 15 minutes to ensure uniform distribution of the lubricant.

The lubricated powder was compressed in a floating ring die placed between the jaws of a hydraulic press at a pressure of 8.5 tonnes per square cm to form a toroidal compact. The pressure was held for a period of 10 seconds and the compact was then released and ejected. The ring die was dimensioned to provide toroidal compacts of 39 mm outside diameter, 28 mm inside diameter and a thickness within the range 6.5 to 8 mm depending on the powder density. The purpose of the added lubricant was to ensure free release of the compact from the die. The compact was then heat treated in air in a muffle furnace at 600° C. for a period of 40 minutes. On withdrawal from the furnace, the compact was placed on a copper faced steel block to cool at a rate in the order of 200° C. per minute. When cold, the compact was insulated with plastic tape and wound with 500 primary turns and 500 secondary turns for magnetic testing.

Coercivity and saturation induction were measured using an LDJ model 5200 D.C. hysteresiograph operating at a maximum field of 24,000 A/m (300 Oe) and the circumferential resistivity was measured using a four point probe method. The results obtained for coercivity, saturation induction and resistivity are shown in Table 1.

EXAMPLES 2, 3 and 4

Toroidal samples were prepared under similar conditions to Example 1 with the exceptions that the strengths of the dichromate solutions were 5%, 2%, and 0.5% by weight respectively and Examples 3 and 4 were each heat treated for a period of 25 minutes. The results obtained for coercivity, saturation induction and resistivity are shown in Table 1.

EXAMPLES 5, 6 and 7

Toroidal samples were prepared under similar conditions to Example 1 with the exception that the heat treatments at 600° C. were carried out in an inert atmosphere of argon for periods of 60 minutes, 120 minutes and 180 minutes respectively. The results obtained for coercivity, saturation induction and resistivity are shown in Table 1.

EXAMPLE 8

In this example, a toroidal sample was prepared from uncoated iron powder, the pressing conditions and heat treatment being similar to those of Example 1. The results for coercivity, resistivity and saturation induction are shown in Table 1. This example was not prepared according to the invention, and the results are included for purposes of comparison.

TABLE 1

| Example | Dichromate Strength % | 600° Heat Treatment Atmosphere | 600° Heat Treatment Time Mins. | Coercivity A/m | Saturations Induction Tesla | Resistivity microhm cm |
|---|---|---|---|---|---|---|
| 1 | 10 | Air | 40 | 204 | 1.41 | 1100 |
| 2 | 5 | Air | 40 | 224 | 1.51 | 600 |
| 3 | 2 | Air | 25 | 208 | 1.59 | 1180 |
| 4 | 0.5 | Air | 25 | 208 | 1.61 | 690 |
| 5 | 10 | Argon | 60 | 232 | 1.41 | 14000 |
| 6 | 10 | Argon | 120 | 216 | 1.37 | 8000 |
| 7 | 10 | Argon | 180 | 224 | 1.35 | 1900 |
| 8 | Uncoated | Air | 40 | 200 | 1.64 | 90 |

The results of Table 1 show that, under a wide range of conditions of preparation, compacts pressed from iron powder pre-coated from an aqueous dichromate solution have been produced with coercivities below 240 A/m and saturation inductions exceeding 1.3 T while maintaining resistivities exceeding 500 microhm cm. The comparative results for an uncoated iron powder, Example 8, show acceptable coercivity and saturation induction, but low resistivity. It will be apparent to one skilled in the art that the above conditions of preparation are by way of example only and conditions may be optimised to meet particular requirements. The results indicate, for example, that higher saturation induction is achievable with weaker dichromate solutions, while higher resistivity at the expense of reduced saturation induction may be obtained by heat treating in an inert atmosphere.

The above results were obtained from toroidal samples. Compacts may be pressed into a wide variety of shapes including, for example, pot cores by using suitable designed dies, although absolute measurements of the magnetic properties of such cores cannot be readily made due to non-uniformity of the magnetic circuit. It is possible, however, to make comparative assessments of cores of similar geometry in terms of their power loss measured under similar conditions of induction. The following examples give practical results obtained from a series of pot cores which were pressed from the same die and were designed to replace a particular fluorescent lighting choke having a laminated silicon iron core. The laminated choke was designed to operate at 200 volts and 50 Hz with a current of 200 mA, and had an inductance of 3.1 H measured at 200 volts and 50 Hz.

EXAMPLES 9, 10, 11, 12 and 13

Pot core samples were pressed from iron powder which had been coated from aqueous potassium dichromate solutions of 10%, 5%, 2%, 0.5% and 0.2% strength by weight respectively. The conditions of preparation were in other respects similar to those of Example 1 with the exception that each core had only a single coil, and the number of turns and wire gauge for each coil were individually chosen so that the inductance and DC resistance closely matched the inductance and resistance of the laminated choke. The samples were tested by connecting the coil to a 200 volt, 50 Hz, power supply and measuring the total power loss W with a wattmeter. The current I in the coil was also measured and the core power loss P was obtained from the expression:

$$P = W - I^2R,$$

Where R is the D.C. resistance of the coil. Results for core power loss are shown in Table 2, this table also giving the number of turns and measured values of current and inductance at 200 volts and 50 Hz.

EXAMPLE 14

A pot core sample was prepared from uncoated iron powder, the conditions of preparation being in other respects similar to those of Examples 9 to 14. This sample was not prepared according to the invention and the results are included in Table 2 for purposes of comparison.

TABLE 2

| Example | Dichromate Strength % | Coil Turns | Inductance Henry | Current at 200 V mA | Core Power Loss Watts |
|---|---|---|---|---|---|
| 9 | 10 | 1945 | 3.05 | 204 | 1.95 |
| 10 | 5 | 1606 | 3.12 | 201 | 1.70 |
| 11 | 2 | 1569 | 3.11 | 202 | 1.82 |
| 12 | 0.5 | 1505 | 3.07 | 205 | 1.81 |
| 13 | 0.2 | 1580 | 3.07 | 205 | 1.72 |
| 14 | Uncoated | 1369 | 3.13 | 195 | 7.04 |

The results of Table 2 show that the core loss, when measured under similar conditions of induction, was below 2 watts in samples prepared from potassium dichromate solutions ranging in strength from 0.2 to 10%, while a sample prepared from uncoated iron powder exhibited a core loss exceeding 7 watts. While these results are comparative, and core loss will depend on core geometry and induction conditions, they indicate the effectiveness of the dichromate coating in reducing core loss in a practical power device. Further evidence of this conclusion was provided by testing Example 10, prepared from a 5% dichromate solution, with a fluorescent lamp under similar conditions to the test conditions for the laminated choke. The compacted powder choke operated satisfactorily, and measurements of the overload current and third harmonic distortion were well within the normally specified limits.

It will be apparent to one skilled in the art that other soluble dichromates would act in a chemically similar manner and that the iron powder may be coated, for example, from a solution of sodium dichromate.

We claim:

1. A method of preparing a magnetic powder compact including the steps of coating an iron based powder from an aqueous solution of a soluble dichromate, drying said coated powder, compressing said coated powder in a die to form said compact and heat treating said compact such that said compact becomes partially sintered.

2. A method according to claim 1 in which said soluble dichromate comprises potassium dichromate.

3. A method according to claim 1 in which said soluble dichromate comprises sodium dichromate.

4. A method according to claim 2 in which said dichromate solution has a strength within the range 0.2% to 10% by weight.

5. A method according to claim 1 in which said powder is an atomised iron powder whose particle diameters lie within the range 75 to 150 μm.

6. A method according to claim 1 in which said coated powder is compressed at a pressure of substantially 8.5 tonnes per square cm.

7. A method according to claim 1 in which said compact is heat treated at a temperature of substantially 600° C.

8. A method according to claim 1 in which said compact is heat treated in an atmosphere of air.

9. A method according to claim 1 in which said compact is heat treated in an inert atmosphere.

10. A method according to claim 9 in which said inert atmosphere comprises argon.

11. A method according to claim 1 in which, following heat treatment, said compact is permitted to cool at a rate of substantially 200° C. per minute.

12. A method according to claim 1 in which a lubricant is added to said dried coated powder before compressing said powder.

13. A magnetic powder contact prepared by a method according to claim 1 and which is suitable for use as a core in a low frequency power device.

14. A magnetic powder compact prepared by a method according to claim 1 and which has a coercivity not exceeding 240 A/m, a saturation induction of at least 1.3 Tesla and a resistivity of at least 500 microhm cm.

* * * * *